US006958177B2

(12) United States Patent
Fujiwara et al.

(10) Patent No.: US 6,958,177 B2
(45) Date of Patent: Oct. 25, 2005

(54) RECYCLABLE IMAGE-RECORDING MEDIUM

(75) Inventors: Toshimitsu Fujiwara, Osaka (JP); Chiaki Yamaoka, Takatsuki (JP)

(73) Assignee: Minolta Co., Ltd., Osaka (JP)

( * ) Notice: Subject to any disclaimer, the term of this patent is extended or adjusted under 35 U.S.C. 154(b) by 124 days.

(21) Appl. No.: 09/928,495

(22) Filed: Aug. 14, 2001

(65) Prior Publication Data

US 2002/0022103 A1 Feb. 21, 2002

(30) Foreign Application Priority Data

Aug. 18, 2000 (JP) ..... 2000-248595
Aug. 18, 2000 (JP) ..... 2000-248601

(51) Int. Cl.[7] ..... B41M 5/40
(52) U.S. Cl. ..... 428/32.26; 428/32.31; 428/32.34; 428/198
(58) Field of Search ..... 428/32.26, 32.31, 428/32.34, 198

(56) References Cited

U.S. PATENT DOCUMENTS 5,362,558 A * 11/1994 Sakaki et al. ..... 428/323
5,985,425 A * 11/1999 Tomizawa et al. ..... 428/212

FOREIGN PATENT DOCUMENTS

| | | | | |
|---|---|---|---|---|
| DE | 198 56 808 | | 6/1999 | |
| EP | 0 981 072 | | 2/2000 | |
| EP | 0 985 543 | | 3/2000 | |
| JP | 04-067043 | | 3/1992 | |
| JP | 06-222604 | | 8/1994 | |
| JP | 10-133522 | | 5/1998 | |
| JP | 10-293510 | | 11/1998 | |
| JP | 2000-206843 | | 7/2000 | |
| JP | 2000-214619 | | 8/2000 | |
| WO | WO 00/37260 | * | 6/2000 | ..... B41M/5/00 |

OTHER PUBLICATIONS

Search Report issued in Application No. EP 01 11 9604.

* cited by examiner

*Primary Examiner*—B. Shewareged
(74) *Attorney, Agent, or Firm*—Burns, Doane, Swecker & Mathis, L.L.P.

(57) ABSTRACT

The present invention is to provide a recyclable mage-recording member from which a printed material such as toner can be removed, characterized in that the printed material can be removed selectively.

11 Claims, 12 Drawing Sheets

RECYCLABLE IMAGE-RECORDING MEDIUM

This application is based on an application Nos. 248595/2000 and 248601/2000, the contents of which are hereby incorporated by reference.

BACKGROUND OF THE INVENTION

1. Field of the Invention

The present invention relates to an image-recording medium, which allows a printed material that has adhered thereto upon formation of an image by using a copying machine or a printer, etc. to be removed therefrom, and which is recyclable repeatedly. In particular, the present invention relates to such an image-recording medium that is suitable for a removing means using a physical frictional force, such as a brushing method using an aqueous solvent like water.

2. Description of the Related Art

In recent years, along with the development of the electrophotographic copying (so-called copying) technology using toner, a great amount of image-recording media such as paper and OHP sheets have been used.

The printed materials, printed or copied on these image-recording media, are difficult to be removed therefrom and such a technology has not been put into practical use; therefore, a great amount of printed materials that have been generated in offices are disposed as wastes when they are no longer used.

It is clear that this situation is not preferable from the standpoint of environmental preservation and protection of resources. For this reason, the technique for reproducing and recycling these image-recording media to be disposed as wastes has been studied hard. For example, Japanese Patent Application Laid-Open No. 222604/1994 has disclosed an image-recording medium in which a swelling layer that is allowed to swell with water is formed on the entire surface of a base layer such as a resin film, paper, metal foil, etc., and this swelling layer is moistened with water to swell so that images recorded on the image-recording media are removed.

The technology of this type is very useful as a method for reproducing unnecessary image-recording media, from the viewpoint of energy and costs. In the image-recording media having such a structure, it is possible to remove all the printed materials printed on the surface thereof, and to recycle the resulting image-recording media.

There have been demands for removing printed image not from the entire surface of the image-recording media but from only one portion thereof so as to recycle the image-recording media. For example, in most cases, platforms such as frames of lists, headlines and company names are common portions, and if the printed characters are removed from the entire surface, the portions using the same character forms and designs need to be reprinted each time recycled, causing a wasteful use of materials for printing and an increase in time-consuming tasks. Therefore, there have been demands for techniques for selectively removing images printed on image-recording media.

In the case of the image-recording medium having the structure disclosed in the above-mentioned Japanese Patent Application Laid-Open No. 222604/1994, the printed material on the entire surface is removed, it being impossible to selectively remove the printed material.

SUMMARY OF THE INVENTION

The objective of the present invention is to provide a recyclable image-recording medium from which a printed material such as toner can be removed, in which the printed material can be removed selectively.

The present invention first relates to a recyclable image-recording medium comprising:

a base layer;

a surface layer comprising a water-swelling resin, the surface layer allowing printed material formed thereon to be separated upon application of an aqueous solvent; and an image that is not separable even when the aqueous solution is applied to the image-recording medium.

Second, the present invention relates to a recyclable image-recording medium comprising:

a base layer; and a surface layer comprising a water-swelling resin, the surface layer allowing printed materials formed thereon to be separated upon application of an aqueous solvent, in which the surface of the image-recording medium has a portion that is not covered with the surface layer, that is, the image-recording medium has a surface that is formed of the water-swelling resin and a material that has a characteristic different from the water-swelling resin.

DETAILED DESCRIPTION OF THE INVENTION

The first invention provides relates to a recyclable image-recording medium comprising:

a base layer;

a surface layer comprising a water-swelling resin, the surface layer allowing printed material formed thereon to be separated upon application of an aqueous solvent; and an image that is not separable even when the aqueous solution is applied to the image-recording medium.

The above-mentioned objective of the first invention is achieved as below: upon formation of the non-separable image, a material for printing that is not lowered in the adhesive strength to the water-swelling resin layer even when the aqueous solvent is applied thereto is used, or a non-separable image is printed on a portion other than the uppermost surface of the water-swelling resin layer, that is, inside the surface of the image-recording medium, for example, in the water-swelling resin layer, or on a layer below the water-swelling resin layer or in this layer. Thereby, the surface layer formed of the water-swelling resin allows the printed material such as toner to be removed from the surface layer by applying an aqueous solvent to the surface layer, while the printed material of the image that does not become separable even when the aqueous solvent is applied is not removed; therefore, it is possible to selectively separate the printed materials. With respect to the application of the aqueous solvent, various means, such as a dipping process of the image-recording medium of the present invention into the aqueous solvent, a spraying process, like a shower process, of the aqueous solvent onto the surface, etc. may be used; and any means may be used as long as the aqueous swelling resin of the surface layer is allowed to swell.

Figure 1:
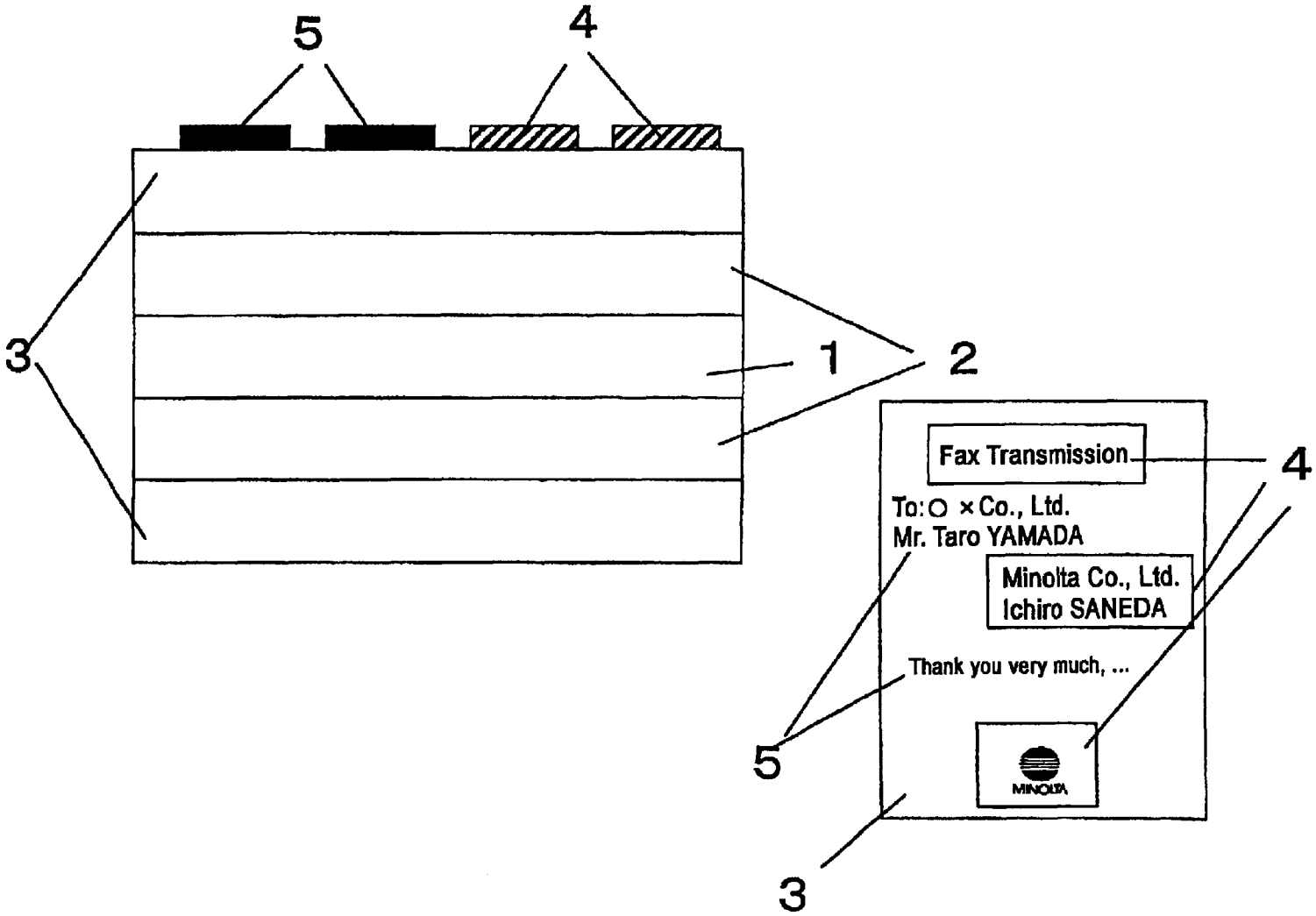
FIG. 1 is a schematic cross-sectional view that shows one embodiment of an image-recording medium in accordance with the first invention.

FIG. 1 is a schematic cross-sectional view of an image-recording medium in accordance with one Embodiment of a first invention. Reference number 1 is a base layer, 2 is an intermediate layer, 3 is a surface layer comprising a water-swelling resin, 4 is a printing material for an image that is non-separable even upon application of the aqueous solvent. Reference number 5 is a printed material formed of toner that becomes separable upon application of the aqueous solvent. In FIG. 1, an intermediate layer 2 is formed; however, in the case when the adhesiveness between the base layer 1 and the surface layer 3 is sufficiently achieved, the intermediate layer 2 may be omitted from the structure. In FIG. 1, the intermediate layer 2 and the surface layer 3 are formed on both of the surfaces of the base layer 1; however, these layers may be formed on only one surface thereof.

The base layer 1 is preferably a plastic film having a water-resisting properties (strength) at least the surface of which is transparent or such a plastic film that is made opaque by addition of inorganic particles. The material of the plastic film is not particularly limited; however, when heat resistance, etc., are taken into consideration, it is preferable to use polyester, polycarbonate, polyimide, polymethyl methacrylate, etc. When versatility, costs, durability, etc. are taken into consideration, it is preferable to use polyester, in particular, polyethylene terephthalate (PET), polyethylene naphthalate (PEN), etc. Various sheets, which are available as OHP, may also be used. Paper made from PET fibers, etc., is also commercially available, and paper made from plastic fibers of this type is effectively used as the base layer. Besides plastic films, materials, such as metal foil, paper having an improved water resistance and composite materials of resin, paper and metal, may also be used. In other words, any material may be used as long as it can maintain a flat face all through printing and removing processes of a printing material and it also has a water resisting properties and a proper mechanical strength.

The intermediate layer 2 is preferably composed of a resin having high adhesiveness to the base layer 1 and the surface layer 3, and to this may be added a compound (reactive compound) having a functional group that can be chemically bonded to the resin of base-layer and/or the resin of surface-layer, if necessary. The intermediate layer, which is formed so as to improve the adhesiveness between the surface layer and the base layer, may be formed for the purposes of static elimination and clear coating.

Such resins as having high adhesiveness may be exemplified by urethane resin, acrylic resin, styrene resin, polyester resin, polycarbonate resin, vinyl acetate resin, vinyl chloride resin, etc., more preferably, polymethylmethacrylate resin, polyester resin, polycarbonate resin, vinyl chloride resin, urethane resin, etc.

With respect to the reactive compound contained, if necessary, although not particularly limited as long as it has a functional group that can be chemically bonded to resins composing the base layer 1 and the surface layer 3, examples thereof include: isocyanate compounds, methylol compounds, aldehyde compounds, epoxy compounds, aziridine compounds. In the case when the resin forming the surface layer 3 is a resin having a hydroxyl group such as polyvinyl alcohol or methyl cellulose, isocyanate compounds, methylol compounds, aldehyde compounds and epoxy compounds are preferably used. In the case when the resin forming the surface layer 3 is a resin having a carboxyl group such as poly(acrylic acid), isocyanate compounds, methylol compounds, epoxy compounds and aziridine compounds are preferably used. These compounds are also used as a crosslinking agent used for a water soluble resin forming the surface layer 3. Specific compounds of these will be disclosed in the description about the surface layer.

In order to coat the base layer 1 with the intermediate layer 2, methods such as a solvent-coating method and a melt-coating method may be used. In the solvent-coating method, a solution formed by dissolving a resin and a desired amount of the above-mentioned reactive compound into a proper solvent such as tetrahydrofran (THF), dioxane, acetone, ethylacetate or methylethylketone (MEK), and the obtained solution is coated and dried. A solution with a resin such as water-soluble or hydrophilic polyurethane and polyester dissolved or dispersed in water may be used. Such a resin solution and a resin emulsion are commercially available. When those solutions are used, coating can be made without using an organic solvent, in particular, a non-aqueous organic solvent. Thus, it becomes possible to improve the safety in the manufacturing process. It becomes possible to prevent a problem in which the image-recording medium is heated, for example, in the copying machine with the result that gas of the residual solvent is generated from the image-recording medium. In the case when an aqueous solvent is used, the addition of a surface active agent thereto makes it easier to apply the intermediate layer. When aqueous solvents are used to form both of the intermediate layer and the surface layer, it is possible to manufacture an image-recording medium without using a non-aqueous organic solvent; thus, it becomes possible to ensure the safety process and also to prevent the problem of residual non-aqueous organic solvent in the image-recording medium. By using the above-mentioned solvent-coating method or the melt-coating method, the intermediate layer is formed so as to have a layer thickness in the range of approximately from 0.5 μm to 20 μm, preferably, approximately from 0.5 μm to 10 μm. The thickness less than 0.5 μm tends to cause irregularities in coating, sometimes resulting in uncoated portions. The thickness exceeding 20 μm tends to cause a problem with the strength, etc. in the image-recording medium.

When the reactive compound itself is a high molecular compound, inherently has an film-forming properties, and is superior in the adhesiveness to the base layer and the surface layer, the compound itself may be dissolved in a solvent etc. and be applied and dried to form the layer. In the case when the reactive compound is added to a resin solution and applied, the addition of the reactive compound is set to, for example, 5 to 50 parts by weight with respect to 100 parts by weight of the resin forming the intermediate layer.

The intermediate layer may be subjected to a corona discharging process. This improves the affinity to the surface layer, and makes it possible to improve the adhesiveness.

In the case when a base layer formed of paper and fabric materials is used, the base layer is dipped into a coating solution that is used to form the intermediate layer, and the base layer is impregnated with the coating solution so that the gaps of the fibers constituting the base layer may be filled with the intermediate layer material.

The surface layer 3 is composed of a resin having water-swelling properties. The water-swelling properties mean that the material swells with water or an aqueous solvent, but does not dissolve therein. This property is given by crosslinking a water-soluble resin. A non-water-soluble component may be added to a water-soluble resin so as to give such properties as absorb a solvent such as water to swell, but are not dissolved in the solvent.

With respect to the water soluble resin, a water soluble resin having a functional group containing an active hydrogen, such as a hydroxyl group, an amino group, an amide group, a thiol group, a carboxyl group and a sulfonic acid group, in its molecule is used. Examples thereof include: polyvinyl alcohol, methylcellulose, polyacrylic acid, carboxylmethylcellulose, hydroxylethylcellulose, polyvinylpyrrolidone, polyacrylamide and diacetone acrylamide. Preferably, Polyvinyl alcohol, methylcellulose and polyacrylic acid are used, and the polymerization degree is set to from 300 to 3000 preferably from 500 to 2000, more preferably from 500 to 1700. It is suitable that such a water soluble resin is dissolved from 2 to 30 parts by weight, preferably from 5 to 10 parts by weight as a solid-state concentration in an aqueous solvent of 100 parts by weight.

In order to change the hydrophilic property and water-absorbing property of the water soluble resin, it may be subjected to an ionic modification. Although not limited to this, the ionic modification means that the active hydrogen of the above-mentioned functional group is partially replaced by, for example, a functional group having a quaternary amine salt at its end or a functional group having an acrylate at its end.

In order to crosslink the water soluble resin, a crosslinking agent and an initiator, if necessary, are added to an aqueous solution of the resin. With respect to the crosslinking agent, any agent may be used as long as it has a reactivity to the hydroxyl group, amide group, or carboxyl group contained in the molecule of the water soluble resin so that it crosslinks the water soluble resin. Examples thereof include an epoxy compound, an isocyanate compound, a methylol compound, an aldehyde compound and an aziridine compound.

Examples of the epoxy compound include: polyethylene glycol diglycidyl ether, polypropylene glycol diglycidyl ether, sorbitol polydiglycidyl ether, sorbitan polydiglycidyl ether and polyglycelol polyglycidyl ether. Besides these, various epoxy compounds may be used.

With respect to isocyanate compounds, those having not less than two isocyanate groups in one molecule may be used. By using a compound having a plurality of isocyanate groups, it becomes possible to firmly bond the base layer and the surface layer to each other.

With respect to such isocyanates, examples thereof include: 4,4-diphenylmethane diisocyanate, 4,4-methylenebiscyclohexyl isocyanate, tris(p-isocyanatephenyl)thiophosphate, tris(p-isocyanatephenyl) methane, a tolylenediisocyanate/trimethylolpropane 3 adduct and aliphatic polyisocyanate having a hydrophilic group in the molecule.

Including these compounds, those isocyanates used in the present embodiment may be protected by phenol, sulfurous acid, etc.

With respect to the methylol compounds, methylolated melamines such as methylol dimethylol melamine and trimethylol melamine, dimethylolated urea, a melamine-formaldehyde resin, etc., are exemplified. Besides these, various methylol compounds may be used, Those having an appropriately higher molecular weight and those having an appropriately long chains are more preferably used; and from this point of view, a melamine-formaldehyde resin is preferably used among the above-mentioned methylol compounds.

Examples of aldehyde compounds include glyoxal, glutaraldehyde, etc. Besides these, various aldehyde compounds may be used.

With respect to the aziridine compounds, examples thereof include: diphenylmethane-bis-4,4'-N,N'-diethylurea, 2,2-bishydroxymethylbutanol -tris-[3-(1-aziridine) propynate]. Polymers containing an oxazoline group may be used.

With respect to the addition of the crosslinking agent, although not particularly determined because it depends on the kinds of resin and crosslinking agent, the molecular weights, the reaction conditions, etc., it is preferably set to from 0.5 to 50 parts by weight, preferably from 1 to 40 parts by weight with respect to 100 parts by weight of the resin. When the addition is too small, the film strength at the time of swelling becomes insufficient, or the film might be dissolved. When the addition is excessive, it is not possible to obtain a sufficient amount of swelling, resulting in degradation in the image-removing function.

A surface active agent may be added to the resin solution for forming the surface layer so as to improve the coating performance. With respect to the surface active agent, not particularly limited, any of anionic, cationic and nonionic agents may be used. The addition thereof is set in the range from not less than 0.1% to not more than 20%, preferably from not less than 0.5% to not more than 10%, with respect to the resin.

In order to improve the printing or writing properties thereon, inorganic fine particles, such as silica, titanium oxide, alumina, zinc oxide and calcium carbonate, may be added to the surface layer. In the case when such inorganic fine particles are added, the addition is set to from 0.5 to 200 parts by weight, preferably from 3 to 30 parts by weight, with respect to 100 parts by weight of the water-soluble resin.

In order to improve the passing properties thereof, a charge preventing treatment by a cationic surface active agent, etc., may be applied to the surface layer, if necessary. The charge preventing agent may be added to the material to form the surface layer, or is dissolved and dispersed in a proper solvent, and this solution may be applied to the surface layer after formation of the surface layer.

With respect to the formation method of the surface layer, a solvent-coating method may be used. More specifically, the above-mentioned water soluble resin, crosslinking agent, and a monomer or an oligomer, and other additive agents, if necessary, are dissolved and dispersed in a proper solvent such as water, a mixture of water and an organic solvent or an organic solvent, and this solution is applied onto the base layer or the intermediate layer.

After the coating process, at least the intermediate layer and the surface layer are heated to from 50 to 180° C., preferably from 100 to 170° C. In the case when an insoluble component is formed by irradiation of light in the surface layer, the heating process is carried out after irradiation of light or at the same time of irradiation.

With respect to the image-recording medium obtained as described above, the printed material 5, which is separable, is removed through processes of swelling of the surface layer, a physical rubbing process by a brush, etc., and a drying process, while the printed material 4, which is not separable, is allowed to remain as it is.

With respect to the printed material 4 that is not separable, any material may be basically used as long as it does not reduce in the adhesive strength to the surface layer 3 so as not to be removed even upon application of the aqueous solvent. More specifically, those materials to be used have a pigment material for developing colors having a very small particle size, or are dissolved in a vehicle of ink, so that they are allowed to permeate into the inside of the surface layer 3 of the water-swelling resin, or those materials have a chemical bond, etc., to the water-swelling resin of the surface layer to firmly adhere thereto.

Although not particularly limited to these, those of the former materials include dye ink, pigment-dispersing ink having a particle size of not more than 1 $\mu$m (in this case, those which form a film with a blended resin on the surface layer with their pigment being not allowed to permeate into the inside of the surface layer 3 are excluded) and Indian ink. Those of the latter materials include UV-curing ink, organic solvent lacquer, colored varnish, ink blended with a crosslinking agent identical to the crosslinking agent of the surface layer, etc.

With respect to the printed material to be separated, toner used for an electrophotographic system is preferably applied, and beside the toner, the following materials may be used: recording materials used for an ink-jet method using hot-melt ink, a thermal transferring method and a printing method, and such materials as adhering to the surface of the image-recording medium to form an image of a coat film shape, such as an oil painting agent. The printed material may be formed by drawing with a marker pen for OHP-use or oil pen that is commercially available.

Figure 2:
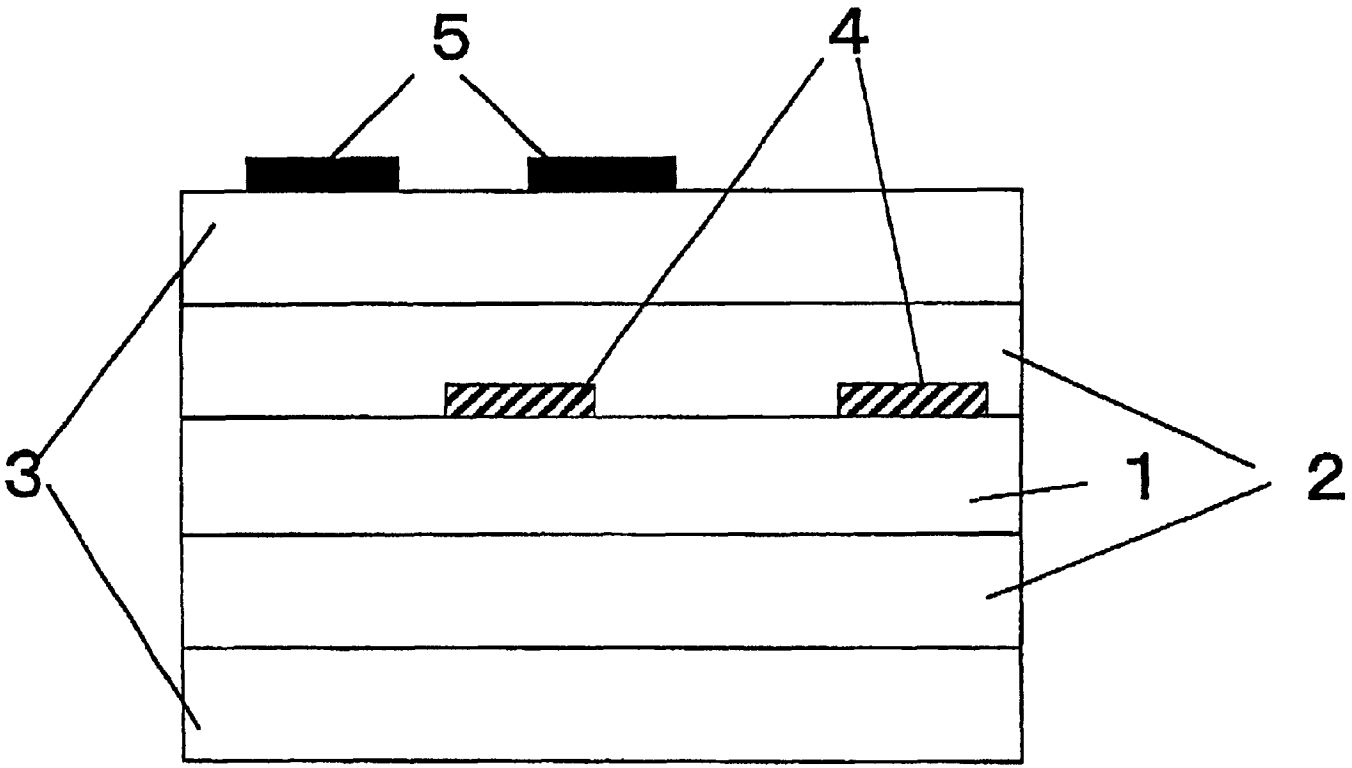
FIG. 2 is a schematic cross-sectional view that shows another embodiment of an image-recording medium in accordance with the first invention.
Figure 4:
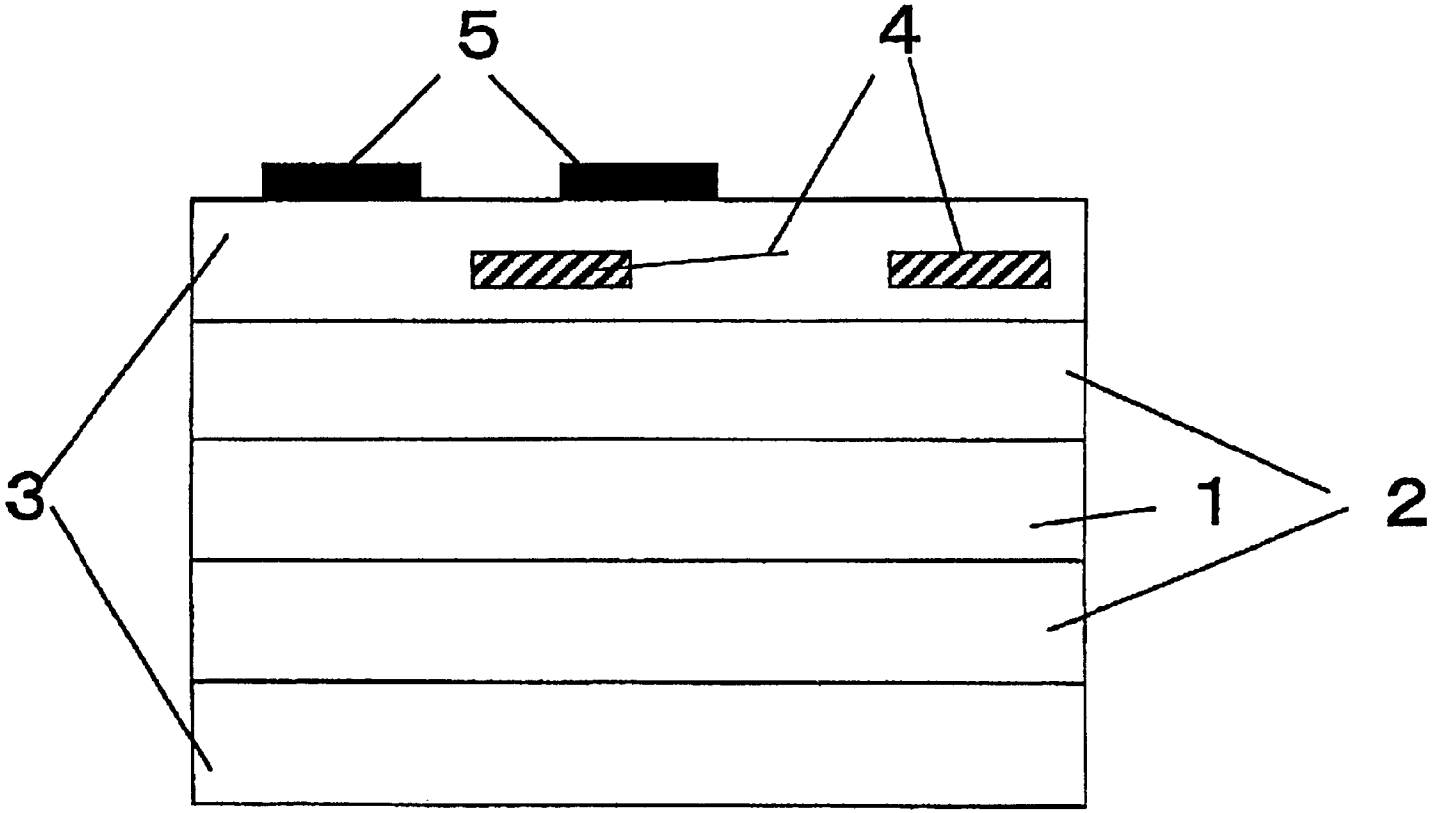
FIG. 4 is a schematic cross-sectional view that shows still another embodiment of an image-recording medium in accordance with the first invention.
Figure 5:
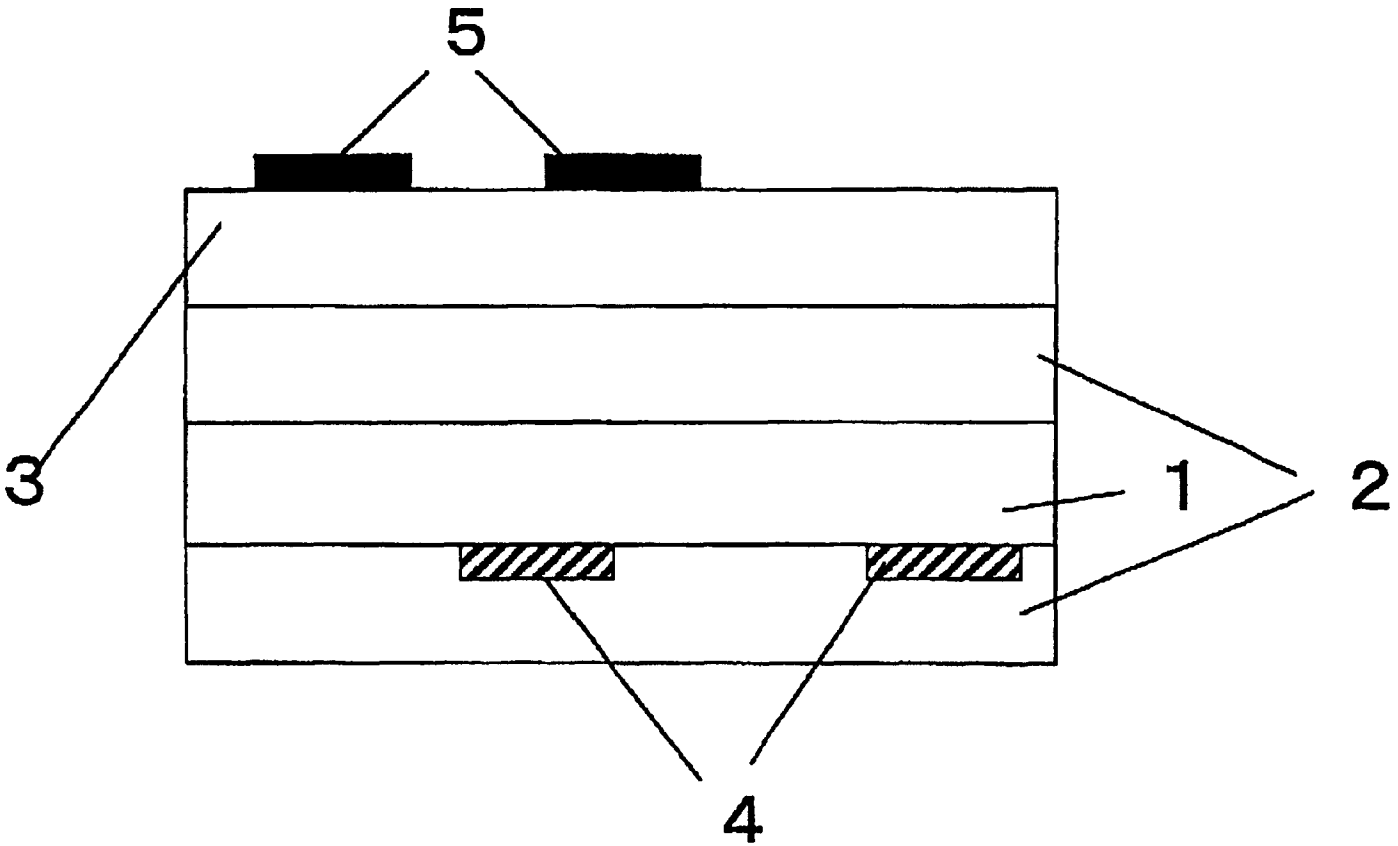
FIG. 5 is a schematic cross-sectional view that shows still another embodiment of an image-recording medium in accordance with the first invention.

FIG. 2, which shows another embodiment of the first invention, is a schematic cross-sectional view that shows the image-recording medium in which the non-separable material 4 is printed on portions other than the surface layer of the water-swelling resin. The non-separable printed material 4 is formed between the base layer 1 and the intermediate layer 2 (on the surface of the base layer). Beside this, any structure may be used other than the structure in which image is printed on the surface of the surface layer 3 from which the image is to be removed. For example, the non-separable printed material 4 may be formed between the surface layer 3 and the intermediate layer 2 on the surface of the intermediate layer 2 (FIG. 3), formed inside the intermediate layer 2 and the surface layer 3 (FIG. 4), or formed on the rear face of the base layer (FIG. 5).

With respect to the base layer 1, the intermediate layer 2 and the surface layer 3 of the image-recording medium shown in FIGS. 2 to 5, the above-mentioned materials and forming methods may be applied as they are explained in the above. With respect to the non-separable printed material 4, any material other than those explained in the structure of FIG. 1 may be used, and as long as it causes no problem with image quality such as bleeding and cissing, the kind thereof is not particularly limited. Materials, such as toner which is used in normal copying machines, printers, ink-jet ink and printing ink etc. may be preferably used, and besides these, a printing material that is identical to the printed material to be removed may also be used. After the non-separable printing material 4 has been printed, the coat layers such as the intermediate layer 2 and the surface layer 3 are formed thereon so that the image-recording media having the structures shown in FIGS. 2 to 5 in which printing is made on portions other than the surface of the surface layer 3, may be obtained.

In order to improve the affinity between the printing material 4 and the coat layer to be formed thereon, treatments such as a corona treatment and an alcohol degreasing treatment may be carried out after an image made from the printing material 4 has been formed.

On the image-recording medium of the first invention thus obtained, in which non-separable images have been preliminarily printed, an image formed of the separable printed material 5 that is to be removed later is printed by a copying machine, or a printer, etc. From the image-recording medium on which the separable image and non-separable image are mixedly formed, it is possible to remove only the separable image selectively by using a removing method of the printed material, which will be described later.

The second invention provides a recyclable image-recording medium comprising:

a base layer; and a surface layer comprising a water-swelling resin, the surface layer allowing printed materials formed thereon to be separated upon application of an aqueous solvent, in which the surface of the image-recording medium has a portion that is not covered with the surface layer, that is, the image-recording medium has a surface that is formed of the water-swelling resin and a material that has a characteristic different from the water-swelling resin.

In the second invention, the aforementioned objective is achieved by leaving an area having no surface layer formed thereon at the time when the image-recording medium is prepared. In other words, with respect to the image-recording medium, the surface formed of the water-swelling resin is allowed to remove the printed material upon application of the aqueous solvent, while the other portions (portions that are not covered with the surface layer) are not allowed to remove the printed material even upon application of the aqueous solvent, since these portions are formed of materials different in their characteristic from the water-swelling resin, for example, the base layer and the intermediate layer; thus, the printed material formed on the surfaces thereof is allowed to remain on the surface even after the printed material-removing process. Consequently, it is possible to selectively separate the printed materials. With respect to the application of the aqueous solvent, various means, such as a dipping process of the image-recording medium of the present invention into the aqueous solvent, a spraying process, like a shower process, of the aqueous solvent onto the surface, etc. may be used; and any means may be used as long as the aqueous swelling resin on the surface layer is allowed to swell.

Figure 6:
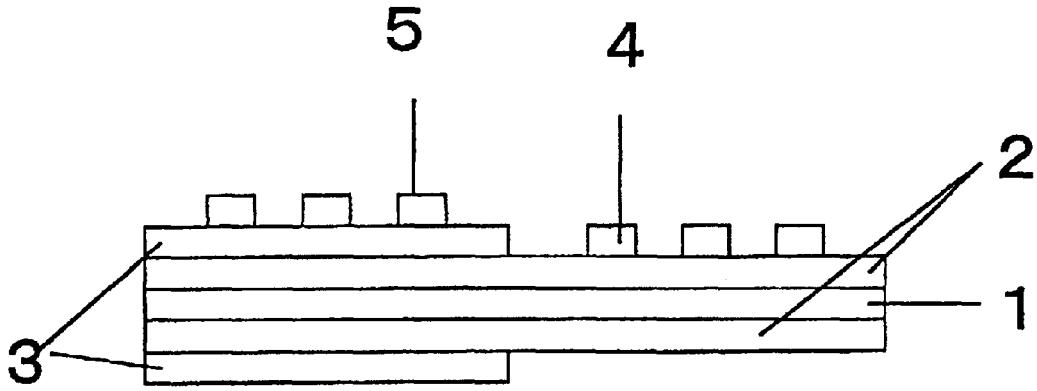
FIG. 6 is a schematic cross-sectional view that shows one embodiment of an image-recording medium in accordance with a second invention.

FIG. 6 is a schematic cross-sectional view that shows an image-recording medium in accordance with one embodiment of the second invention. Reference number 1 is a base layer, and 2 is an intermediate layer in which the material printed on its surface is not allowed to become separable even upon application of an aqueous solvent. Reference number 3 is a surface layer formed of a water-swelling resin, which allows the material printed on its surface to be separable upon application of the aqueous solvent. The intermediate layer is a layer on which images 4 (images that are not removed), such as table frames, headlines and a company name, that need not be rewritten are formed. As illustrated in FIG. 6, this layer may be formed on the entire surface of the base layer, or may be formed partially on necessary portions. The surface layer is formed on portions to be used repeatedly, in which images 5 (images to be removed) to be rewritten are formed.

In FIG. 6, the intermediate layer 2 is formed; however, if printing is directly made on the base layer 1, and if the printed material on its surface is not separable even upon application of an aqueous solvent, a structure without the intermediate layer 2 may be used. In this case, in the resulting image-recording medium, the base layer is exposed at portions not covered with the surface layer. In FIG. 6, the intermediate layer 2 and the surface layer 3 are formed on both of the surfaces of the base layer 1; however, these layers may be formed only on either of the surfaces. Illustrated in FIG. 6, the intermediate layer may be formed on the entire surface of the base layer, or may be formed on surface portions of the base layer other than the portions on which the surface layer is formed later. In this resulting image-recording medium, the intermediate layer is exposed at the portions not covered with the surface layer. If the printed material that is directly printed on the base layer is not allowed to become separable even upon application of the aqueous solvent, the intermediate layer may be formed only on the surface portions of the base layer on which the surface layer is to be formed. In this case, the base layer is exposed at the portions not covered with the surface layer.

In the second invention, with respect to the base layer 1, the intermediate layer 2 and the surface layer 3, those explained in the first invention may be used as they are in its material and formation method; however, mainly from the viewpoint of adhesiveness to the printing material, the intermediate layer 2 is formed in such a manner that images printed on its surface are not allowed to become separable even upon application of an aqueous solvent. The intermediate layer 2 may be formed from the viewpoints of improving the adhesiveness between the surface layer and the base layer, preventing a static charge and providing a clear coat. When the intermediate layer is subjected to a corona discharging process, it becomes possible to improve not only the adhesiveness to the surface layer, but also the adhesiveness to the printed material.

In the second invention, with respect to the printing material, "the printed material to be removed", explained in the first invention may be used as it is. When printed on the surface layer, the printing material of this type becomes separable upon application of an aqueous solvent; however, when printed on layers other than the surface layer (for example, the intermediate layer and/or the base layer), this is not allowed to be separable even upon application of the aqueous solvent.

Similarly to the first invention, the second invention allows images to be preliminarily printed on portions other than the outermost surface of the surface layer, that is, the inner side under the surface of the image-recording medium, for example, inside the surface layer, or on a layer below the surface layer or inside the layer. Such images preliminarily formed on the inner side under the surface of the image-recording medium are not allowed to become separable even upon application of the aqueous solvent, thereby making it possible to provide a selective separation of the printed material. More specifically, these images may be formed between the intermediate layer and the base layer (on the surface of the base layer), between the surface layer and the intermediate layer (on the intermediate layer), inside the intermediate layer or the surface layer, or on the rear face of the base layer.

On the image-recording medium of the second invention thus obtained, a printing process is carried out by a copying machine, a printer, etc., in which the above-mentioned printing material is used. When the image-recording medium of this type is applied to a removing method of the printed material, which will be described later, it becomes possible to selectively remove only the images printed on the surface layer from the image-recording medium. In contrast, the images printed on the layers other than the surface layer (for example, the intermediate layer and/or the base layer) and/or images preliminarily formed on the inner side under the surface of the image-recording medium are allowed to remain without being removed, through the above-mentioned method.

Figure 7:
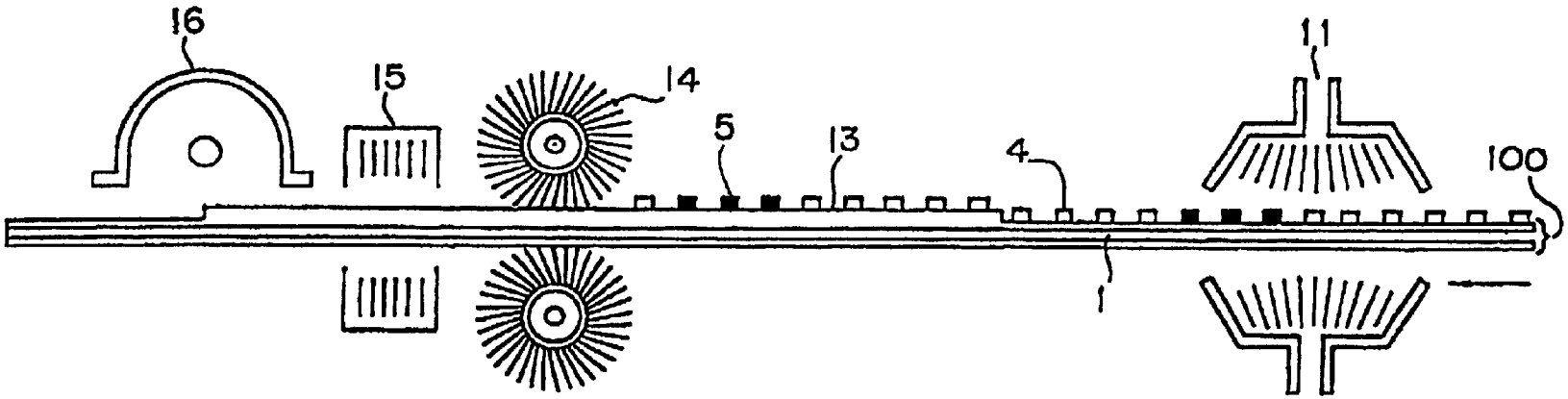
FIG. 7 is a drawing that shows a sequence of processes in a removing method for a printed material.

The method for removing the printed material to which the image-recording media of the first invention and the second invention are applied is provided with processes of: supplying a solvent for allowing the surface layer to swell to the image-recording medium on which an image to be removed has been printed, and scraping the image from the surface of the image-recording medium that has swelled, by using a physical force. Referring to FIG. 7, a detailed explanation will be given of a case in which the image-recording medium on which the printed materials 4, 5 have been printed as illustrated in FIG. 1 is adopted; and in the case when the image-recording medium of FIG. 6 is adopted, the explanation is the same as that given in the case when the image-recording medium of FIG. 1 is adopted, except that the printed material (image) printed on the surface layer forms "the printed material (image) 5 to be separated" and the printed material (image) printed on the intermediate layer forms "the printed material (image) 4 not to be separated".

FIG. 7 is a drawing that shows a sequence of processes and that explains one example of the removing method of the printed material. In FIG. 7, on an image-recording medium 100, the printed materials 4, 5, as shown in FIG. 1, are printed at respective portions. The image-recording medium is transported from right to left in the Figure.

First, a swelling solvent is supplied from a solvent-supplying device 11 to the image-recording medium on which the printed materials 4, 5 have been printed. With respect to the solvent for allowing the surface layer to swell, various solvents, such as an aqueous solvent, that is, a mixed solvent of water and a water-soluble organic solvent, or an aqueous organic solvent, may be used. Desired additive agents, such as a surface active agent and inorganic fine particles, may be added thereto. The present embodiment has a great advantage in that the printed material is removed by using water. The following description will exemplify a case in which water is used.

As illustrated in FIG. 7, the supply of water may be carried out by using a shower device 11 which applies water shower to the surface layer, or, although not shown in Figures, the image-recording medium may be dipped into water. It is preferable to make the image-recording medium in contact with water for approximately 15 seconds to 300 seconds in order to allow water to permeate into the surface of the image-recording medium. The longer the contact time, the more sufficiently water is allowed to permeate therein; however, the processing time is prolonged correspondingly. When water has permeated into the image-recording medium, only the surface layer of the surface is allowed to swell (13 represents the swelled surface layer) so that the adhesive strength between the surface layer and the printed material 5 to be separated is weakened. At this time, the water temperature is preferably set approximately in the range of from 15° C. to 45° C. When the temperature is too high, there is too much water evaporation, and when the temperature is too low, the cleaning effect might become insufficient.

After water has permeated into the surface of the image-recording medium sufficiently, the image-recording medium is further transported to a printed material removing area at which a brush 14 is used thereon. The brush 14 is rotated so that the printed material 5 is removed from the image-recording medium 100 by the brush. In the present invention, besides the brush, any other means for applying a physical or mechanical force to the surface so as to rub or scrape the surface, such as a blade or cloth, may be adopted. In FIG. 7, the brush 14 is placed out of the liquid; however, this may be placed inside the liquid. The length of hair of the brush 14 is set to approximately from 5 to 20 mm, and the thickness is set to approximately from 10 to 60 $\mu$m. Not particularly limited, nylon etc. may be used as the material.

The paper feeding speed, that is, the speed at which the image-recording medium passes through the brush 14, is determined by taking the balance of the processing time and the cleaning performance into consideration, and is set to, for example, from 0.5 cm/sec to 5 cm/sec. The rotation speed of the brush is preferably set to not less than 5 times the transporting speed, preferably not less than ten times the transporting speed.

In these processes, since the printed material 4, which is not separated, does not have a reduction in its adhesive strength, it is not removed. As illustrated in FIGS. 2 to 5, the same is true for the arrangements in which the printed material that is not separable is not printed on the swellable surface layer. It becomes possible to selectively remove and reproduce the Image.

After the printed material 5 has been removed, the image-recording medium is transported to a shower area at which the surface of the image-recording medium is subjected to a cleaning shower 15 so that the residual printed material 5 on the surface of the image-recording medium is washed out. With respect to the solution used as the shower 15, the same aqueous solvent used for allowing the surface layer to swell may be used. It is more preferable to use water.

After the shower 15 has been applied thereto, the image-recording medium is further transported to a drying area at which it is dried by a dryer 16. The drying method may be of a contact type such as a heat roller, or of a non-contact type such as a far infrared lamp. The heating temperature is preferably set in the range of from 70 to 150° C.

In the case when the image-recording medium of FIG. 6 is applied, with respect to the printed material of an image 4 printed on the intermediate layer 2 in these processes, since the intermediate layer is not allowed to swell with water, its adhesive strength is not lowered so that the printed material is not removed. It becomes possible to selectively remove and reproduce images.

Figure 8:
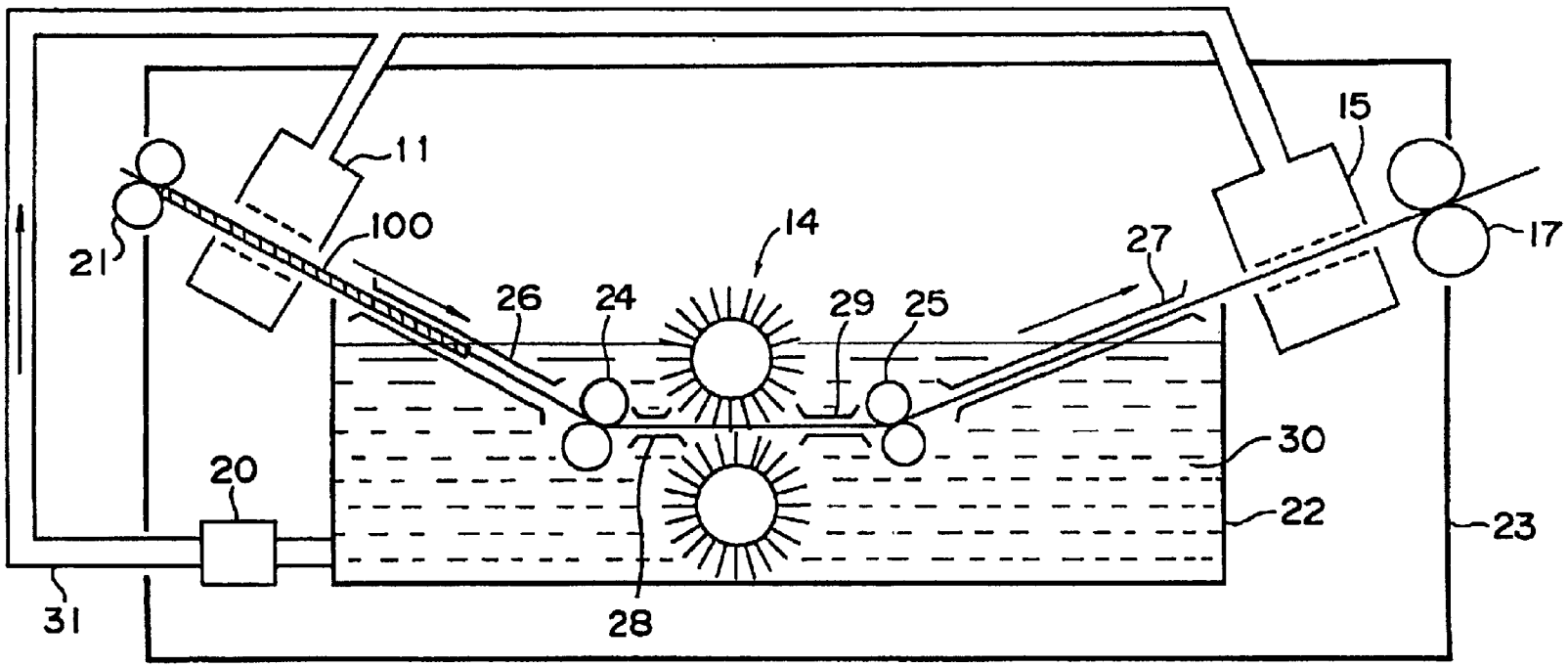
FIG. 8 is a drawing that shows one example of a cleaning device.

FIG. 8 is a drawing that shows one embodiment of a cleaning device to which the above-mentioned cleaning method is applicable. The device shown in FIG. 8 is provided with a cleaning vessel 22 for storing a solution 30 used for allowing the surface to swell in a casing 23. A pump 20, provided with a filter for removing the printed material in the solution inside the vessel, is connected to the cleaning vessel 22, and a swelling shower 11 and the rinsing shower 15 are further connected to the pump 20 through a pipe 31.

The solution inside the cleaning vessel 22 is purified by the filter inside the pump 20, then sent to the showers 11, 15 through the pipe 31, and is used as a swelling liquid at the shower 11, and is also used as a rinsing liquid at the shower 15.

The image-recording medium is transported to the inside of the device by a paper-feeding roller 21. After the swelling liquid is applied by the shower 11, the recording medium is dipped into the solution 30 inside the cleaning vessel 22 after passing through a guide 26 and a transport roller 24. After having been maintained still for a predetermined time, this is sent to a section opposing the brush 14 by the transport roller 24 and a guide 28, at which the printed material 5 is removed.

Thereafter, the image-recording medium is allowed to pass through a guide 29, a transport roller 25 and a guide 27, and subjected to a rinsing liquid by the shower 15, and this is lastly dried by a drying roller 17, and discharged out of the device.

The following description will discuss examples of the manufacturing method of an image-recording medium in accordance with the first and second inventions. In the following examples A1, A2, A3 and A5 and B1 to B4, the intermediate layer and the surface layer are formed on both of the surfaces of the base layer; however, these may be formed on one surface. In order to eliminate the possibility of curling, etc., the layer formation on both of the surfaces is preferable.

EXAMPLES

Example A1

Base Layer

A white-color polyethylene terephthalate (PET) film having a thickness of 100 $\mu$m, trade name: Diahoil W400E43 (made by Diahoil Hoechst Limited), was used as a base layer. On this was printed an image that was not to be removed (hereinafter, referred to as "pre-print image")(an image that was not to be separable) by using a full-color printer COLOR PAGEPRESTO N4P612 (made by Casio K.K.).

This was subjected to a corona process in order to improve the affinity to a material to be coated thereon. The corona process was carried out under conditions of an output power of 0.2 kW and a processing rate of 1.5 m/min.

Intermediate Layer

To 100 g of a water-dispersing urethane resin solution (HUX-232, made by Asahi Denka K.K.) (solid content: approximately 15%) were added 5 g of a melamine-formaldehyde resin (Sumirez Resin 613: made by Sumitomo Kagakukogyo K.K.) and 0.2 g of polyoxyethylene nonylphenylether. This mixed solution was stirred for 5 minutes to form a resin solution for forming an intermediate layer. This resin solution was applied to both of the entire surfaces of the base layer by a bar coater using a wire bar of #10, and dried at 130° C. for one minute to give an intermediate layer 2 having a thickness of 5 $\mu$m.

Surface Layer

In 60 g of water was dissolved 40 g of polyacrylic acid jurimer AC-10H (made by Nippon Jyunyaku K.K.) (solid content: approximately 20%) serving as a water soluble resin to give a resin solution. To this resin solution were added 1.2 g of epoxy crosslinking agent (Dinacol EX-313, made by Nagase Kasei K.K.), 0.2 g of polyoxyethylene nonylphenylether, 0.15 g of sodium hydroxide and 1 g of silica fine particles (Sylysia 450, made by Fuji Sylysia K.K.), and stirred for 15 minutes to give a resin solution for a surface layer.

The resulting solution was applied to both of the surfaces of the image-recording medium coated with the intermediate layer, by a bar coater using a wire bar of #30. After having been dried at 130° C. for one minute, this was further heated at 170° C. for 10 seconds to allow the crosslinking to progress. Thus, a surface layer 3 having a thickness of 5 μm was obtained.

By using a sheet obtained as described above, an image was printed on the surface layer 3 by using a full-color printer COLOR PAGEPROSTO N4P612 (made by Casio K.K.) in the same manner as the preprint image; thus, sheet A1 was obtained. FIG. 2 shows a schematic diagram of sheet A1.

The sheet A1 was subjected to a removing process for the printed material by using a cleaning device shown in FIG. 8. The printed material 4 forming the pre-print image was not removed with only the printed material 5 on the surface layer 3 being removed.

Example A2

Base Layer

A white-color polyethylene terephthalate (PET) film having a thickness of 100 μm, trade name: Diahoil W400E43 (made by Diahoil Hoechst Limited), was used as a base layer.

Intermediate Layer

A resin solution for an intermediate layer was obtained in the same processes as example A1. The resin solution was applied to both of the entire surfaces of the base layer by a bar coater using a wire bar of #10, and was dried at 130° C. for one minute to give an intermediate layer 2 having a thickness of 5 μm.

After the intermediate layer was formed, a pre-print image was printed on its surface by using a full-color printer COLOR PAGEPROSTO N4P612 (made by Casio K.K.).

Surface Layer

Figure 3:
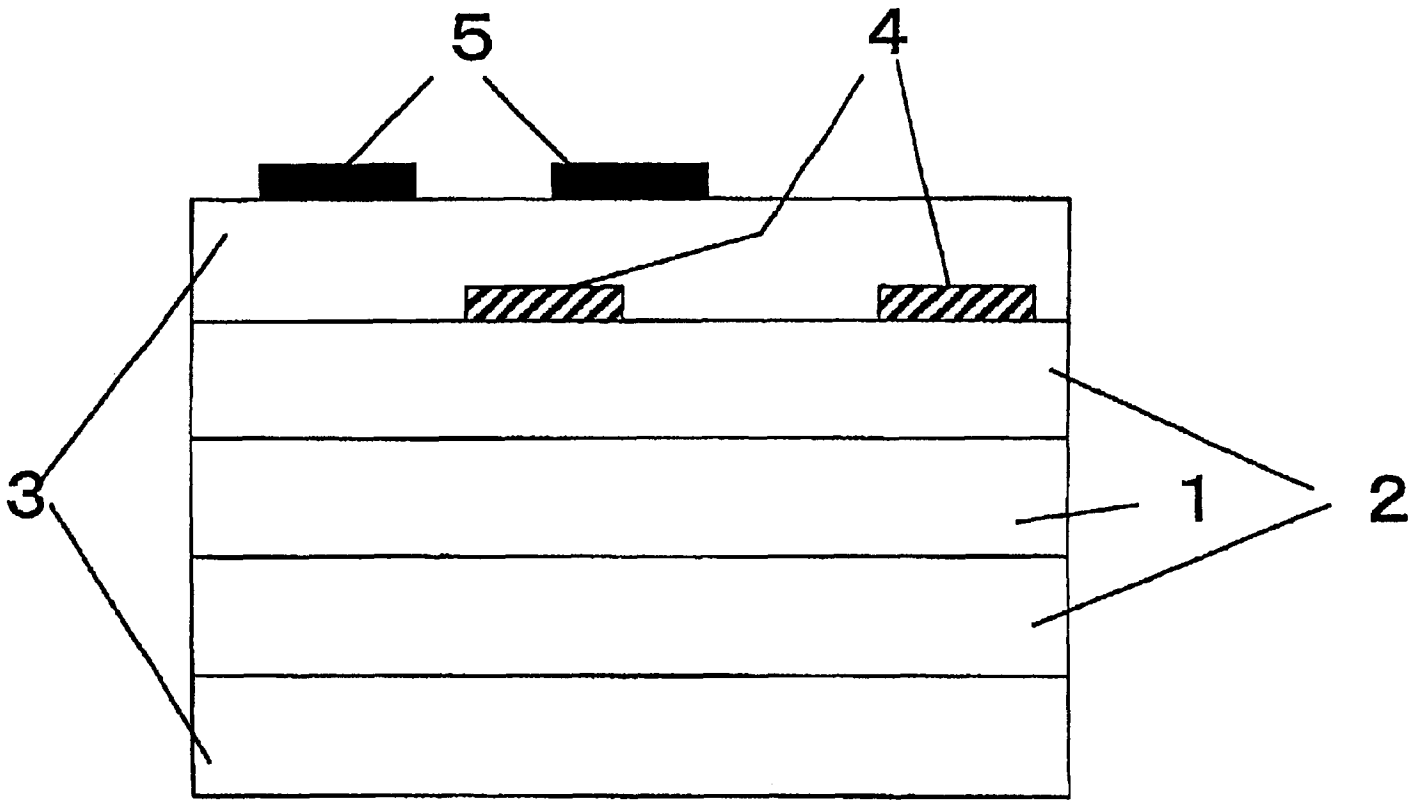
FIG. 3 is a schematic cross-sectional view that shows still another embodiment of an image-recording medium in accordance with the first invention.

A resin solution for a surface layer was obtained by carrying out the same processes as example A1. In the same manner as example A1, a surface layer 3 having a thickness of 5 μm was formed on each of the surfaces of the image-recording medium. An image was printed thereon in the same manner by using a full-color printer COLOR PAGEPROSTO N4P612 (made by Casio K.K.) to form sheet A2. FIG. 3 shows a schematic perspective view of sheet A2.

The sheet A2 was subjected to a removing process for the printed material by using a cleaning device shown in FIG. 8. The printed material 4 forming the pre-print image was not removed with only the printed material 5 on the surface layer 3 being removed.

Example A3

Base Layer

A white-color polyethylene terephthalate (PET) film having a thickness of 100 μm, trade name: Diahoil W400E43 (made by Diahoil Hoechst Limited), was used as a base layer.

Intermediate Layer

A resin solution for an intermediate layer was obtained in the same processes as example A1. The resin solution was applied to both of the entire surfaces of the base layer by a bar coater using a wire bar of #10, and dried at 130° C. for one minute to obtain an intermediate layer 2 having a thickness of 5 μm.

Surface Layer

A resin solution for a surface layer was obtained by carrying out the same processes as example A1. In the same manner as example A1, this was applied to both of the surfaces of the image-recording medium by using a wire bar of #20, and dried to give surface layers 3, each having a thickness of 3 μm. Next, a pre-print image was printed on the surface thereof by using a full-color copying machine LIMOS910 (made by Minolta K.K.). Moreover, the resin solution for forming a surface layer was further applied on this by using a wire bar of #20, and dried to form a surface layer 3 having a thickness of 3 μm (total 6 μm). Then, an image was printed on this by using a full-color copying machine LIMOS910 (made by Minolta K.K.) to form sheet A3. FIG. 4 shows a schematic diagram of sheet A3.

The sheet A3 was subjected to a removing process for the printed material by using a cleaning device shown in FIG. 8. The printed material 4 forming the pre-print image was not removed with only the printed material 5 on the surface layer 3 being removed.

Example A4

Base Layer

A transparent polyethylene terephthalate (PET) film having a thickness of 100 μm, trade name: Lumilar 100T60 (made by Toray K.K.), was used as a base layer. On this was printed a pre-print image by using a full-color printer COLOR PAGEPRESTO N4P612 (made by Casio K.K.).

This was subjected to a corona process in order to improve the affinity to a material to be coated thereon. The corona process was carried out under conditions of an output power of 0.2 kW and a processing rate of 1.5 m/min.

Intermediate Layer

A resin solution for an intermediate layer was obtained in the same processes as example A1. The resin solution was applied to both of the entire surfaces of the base layer by a bar coater using a wire bar of #10, and dried at 130° C. for one minute to give an intermediate layer 2 having a thickness of 5 μm.

Surface Layer

A resin solution for forming a surface layer was obtained in the same manner as example A1. This resin solution was applied onto only the surface on which no pre-print image was printed, and dried to form a surface layer 3 in the same as example A1. The applying and drying processes were carried out under the same conditions as example A1. An image was printed only on the surface layer 3 by using a full-color printer COLOR PAGEPROSTO N4P612 (made by Casio K.K.) to form sheet A4. FIG. 5 shows a schematic diagram of sheet A4.

The sheet was subjected to a removing process for the printed material by using a cleaning device shown in FIG. 8. The printed material 4 forming the pre-print image was not removed with only the printed material 5 on the surface layer 3 being removed.

Example A5

Base Layer

A white-color polyethylene terephthalate (PET) film having a thickness of 100 μm, trade name: Diahoil W400E43 (made by Diahoil Hoechst Limited), was used as a base layer.

Intermediate Layer

A resin solution for an intermediate layer was obtained in the same processes as example A1. The resin solution was applied to both of the entire surfaces of the base layer by a bar coater using a wire bar of #10, and dried at 130° C. for one minute to give an intermediate layer 2 having a thickness of 5 μm.

Surface Layer

A resin solution for forming a surface layer was obtained in the same manner as example A1. This resin solution was applied and dried to form a surface layer 3 in the same as example A1. The applying and drying processes were carried out under the same conditions as example A1.

On the surface layer 3, a pre-print image was formed by using UV-curing ink as a printing material that has a high adhesive property to this layer. Further, an image was printed thereon by using a full-color printer COLOR PAGEPROSTO N4P612 (made by Casio K.K.) to form sheet A5. FIG. 1 shows a schematic diagram of sheet A5.

The sheet A5 was subjected to a removing process for the printed material by using a cleaning device shown in FIG. 8. The printed material 4 forming the pre-print image was not removed, and only the printed material 5 printed by COLOR PAGEPROSTO N4P612 (made by Casio K.K.) was removed.

Example B1

Base Layer

A white-color polyethylene terephthalate (PET) film having a thickness of 100 μm, trade name: Diahoil W400E43 (made by Diahoil Hoechst Limited), was used as a base layer.

Intermediate Layer

To 100 g of a water-dispersing urethane resin solution (HUX-232, made by Asahi Denka K.K.)(solid content: approximately 15%) were added 5 g of a melamine-formaldehyde resin (Sumirez Resin 613: made by Sumitomo Kagaku Kogyo K.K.) and 0.2 g of polyoxyethylene nonylphenylether. This mixed solution was stirred for 5 minutes to form a resin solution for forming an intermediate layer. This resin solution was applied to both of the entire surfaces of the base layer by a bar coater using a wire bar of #10, and dried at 130° C. for one minute to give an intermediate layer 2 having a thickness of 5 μm.

After the intermediate layer was formed, a pre-print image forming process was carried out on the surface thereof. By using the sheet on the surface of which the intermediate layer was formed, a pre-print image indicated by reference numeral 4 in FIG. 9 was printed on the upper half portion of the sheet by using a full-color printer COLOR PAGEPROSTO N4P612 (made by Casio Surface Layer In 60 g of water was dissolved 40 g of polyacrylic acid jurimer AC-10H (made by Nippon Jyunyaku K.K.) (solid content: approximately 20%) serving as a water soluble resin to give a resin solution. To this resin solution were added 1.2 g of epoxy crosslinking agent (Dinacol EX-313, made by Nagase Kasei K.K.), 0.2 g of polyoxyethylene nonylphenylether, 0.15 g of sodium hydroxide and 1 g of silica fine particles (Sylysia 450, made by Fuji Sylysia K.K.). This solution was stirred for 15 minutes to give a resin solution for a surface layer.

The resulting solution was applied to only the lower half portion of the printing surface of the image-recording medium coated with the intermediate layer on its entire surface by using a wire bar of #30. The coated solution was dried at 130° C. for one minute, and further heated at 170° C. for 10 seconds to allow the crosslinking to progress. Thus, a surface layer 3 having a thickness of 5 μm was obtained.

Figure 9:
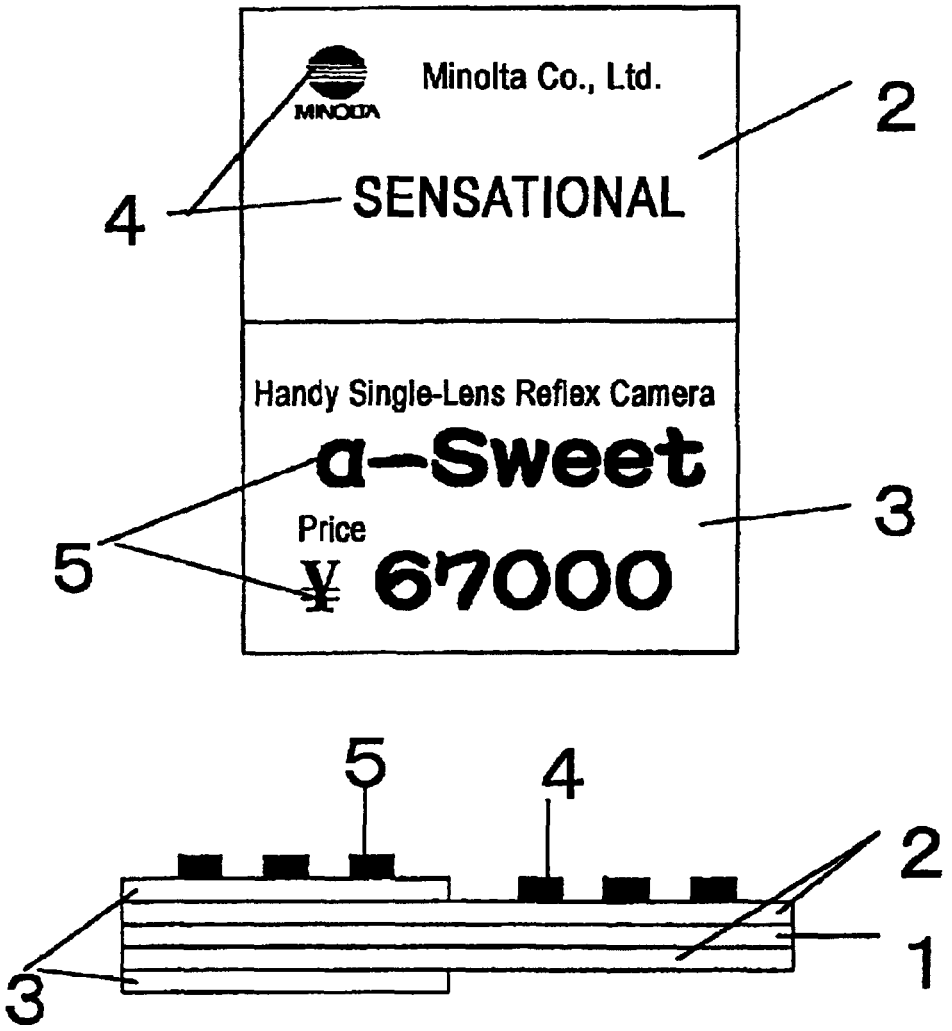
FIG. 9 is a drawing that shows one embodiment of an image-recording medium in accordance with the second invention.

By using a sheet obtained as described above, an image, indicated by reference number 5 in FIG. 9, was printed only on the surface layer 3 by using a full-color printer COLOR PAGEPROSTO N4P612 (made by Casio K.K.) in the same manner as the preprint image. Thus, sheet B1 was obtained. FIG. 9 shows a schematic diagram of sheet B1.

The sheet B1 was subjected to a removing process for the printed material by using a cleaning device shown in FIG. 8. The printed material 4 forming the pre-print image was not removed with only the printed material 5 on the surface layer 3 being removed.

Example B2

Base Layer

A foam white-color polyethylene terephthalate (PET) film having a thickness of 75 μm, trade name: Lumilar 75E63 (made by Toray K.K.), was used as a base layer. On the upper half portion of this film was printed a pre-print image (see reference numeral 4 in FIG. 10) by using a full-color printer COLOR PAGEPRESTO N4P612 (made by Casio K.K.).

Surface Layer

Figure 10:
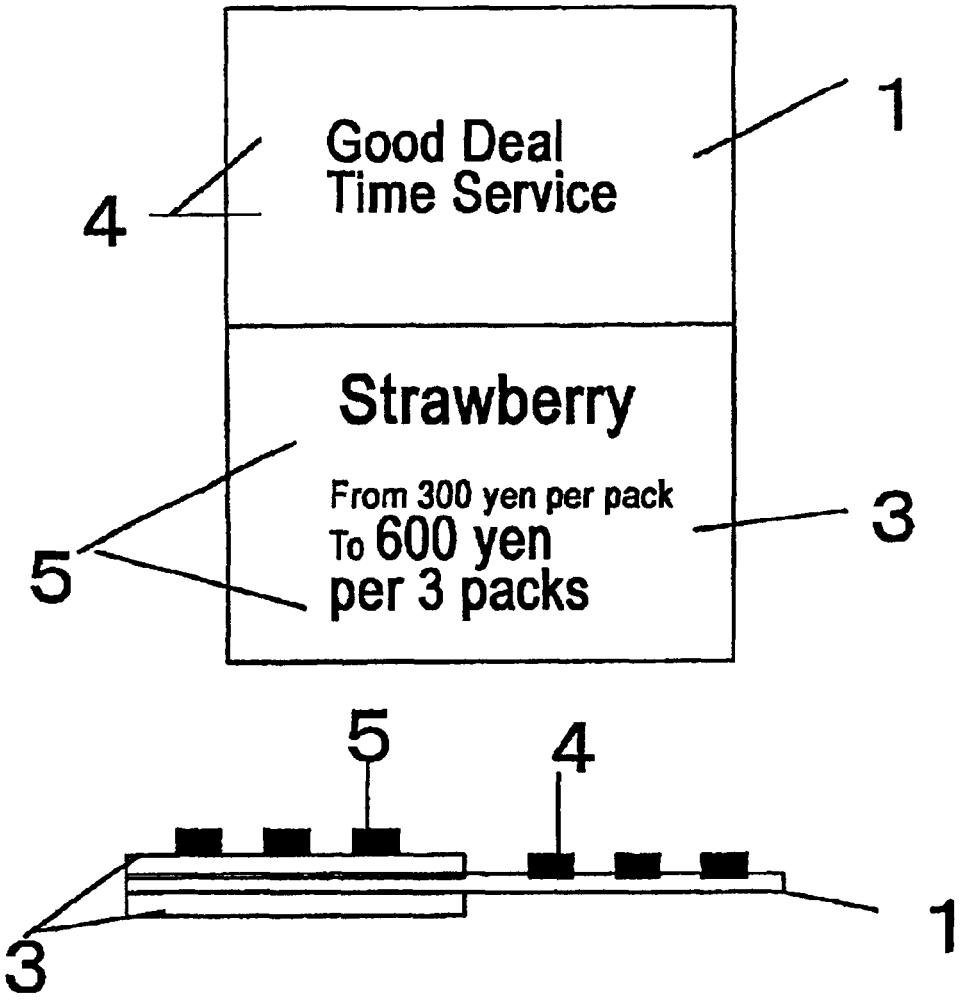
FIG. 10 is a drawing that shows another embodiment of an image-recording medium in accordance with the second invention.

A resin solution for forming a surface layer was obtained in the same manner as example B1. A surface layer 3 having a thickness of 5 μm was formed only on the lower half portion of the printing surface of the image-recording medium in the same manner as example B1. An image (see reference number 5 in FIG. 10) was printed only on this portion to form sheet B2. FIG. 10 shows a schematic diagram of sheet B2.

The sheet B2 was subjected to a removing process for the printed material by using a cleaning device shown in FIG. 8. The printed material 4 forming the pre-print image was not removed with only the printed material 5 on the surface layer 3 being removed.

Example B3

Base Layer

A white-color polyethylene terephthalate (PET) film having a thickness of 100 μm, trade name: Diahoil W400E43 (made by Diahoil Hoechst Limited), was used as a base layer. On this was printed a pre-print image (see reference numeral 4 in FIG. 11) by using a full-color printer COLOR PAGEPRESTO N4P612 (made by Casio K.K.). The printing surface was subjected to a corona discharging process in order to improve the adhesive property to the intermediate layer.

Intermediate Layer

A resin solution for an intermediate layer was obtained in the same processes as example B1. The resulting resin solution was applied to both of the entire surfaces of the base layer having the pre-print image formed in the above-mentioned process by a bar coater using a wire bar of #10, and dried at 130° C. for one minute to give an intermediate layer 2 having a thickness of 5 μm.

Surface Layer

Figure 11:
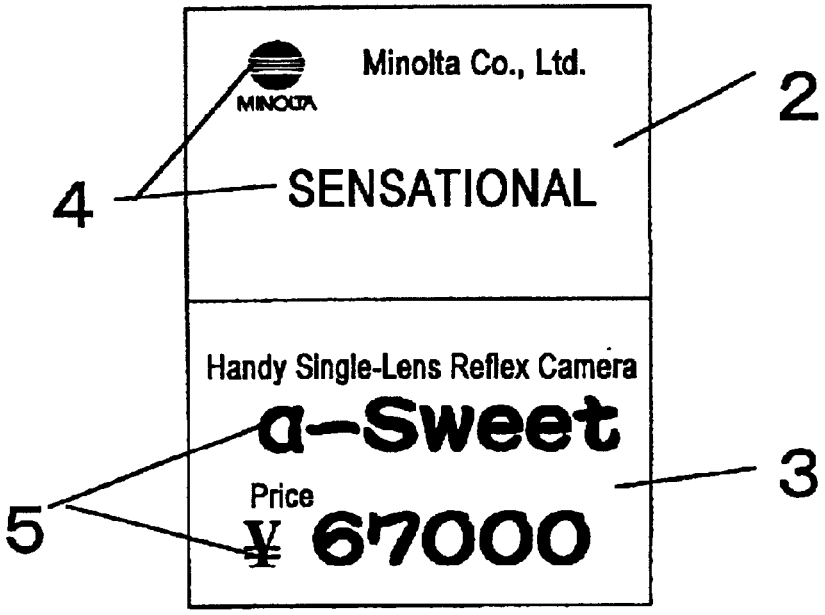
FIG. 11 is a drawing that shows still another embodiment of an image-recording medium in accordance with the second invention.
Figure 11:
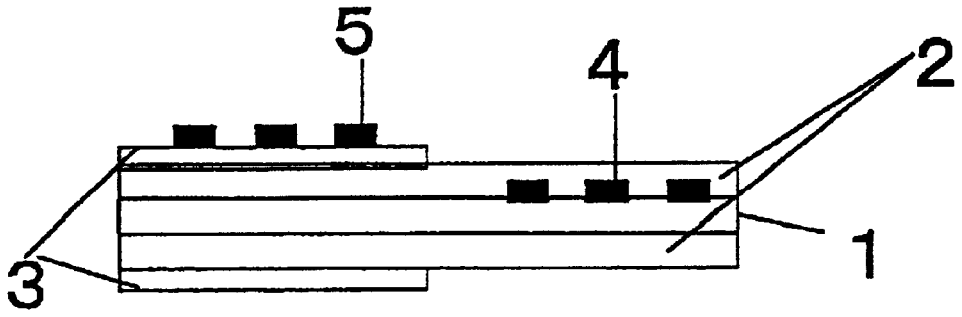

A resin solution for forming a surface layer was obtained in the same manner as example B1. A surface layer 3 having a thickness of 5 μm was formed only on the lower half portion of the printing surface of the image-recording medium in the same manner as example B1, and an image (see reference number 5 in FIG. 11) was printed only on this portion to form sheet B3. FIG. 11 shows a schematic diagram of sheet B3.

The sheet B3 was subjected to a removing process for the printed material by using a cleaning device shown in FIG. 8. The printed material 4 forming the pre-print image was not removed with only the printed material 5 on the surface layer 3 being removed. The pre-print image 4 was coated with the intermediate layer 2 that had high transparency and gloss so that the preprint image was vivid and impressive.

Example B4

Base Layer

Commercial CF paper (made by Minolta K.K.) was used as a base layer.

Intermediate Layer

A resin solution for an intermediate layer was obtained in the same processes as example B1. The resin solution was applied to both of the entire surfaces of the base layer by a bar coater using a wire bar of #10, and dried at 130° C. for one minute to obtain an intermediate layer 2 having a thickness of 5 $\mu$m.

After the intermediate layer was formed, a preprint image (see reference numeral 4 in FIG. 12) was printed on the surface thereof by using a full-color printer COLOR PAGEPROSTO N4P612 (made by Casio K.K.).

Surface Layer

Figure 12:
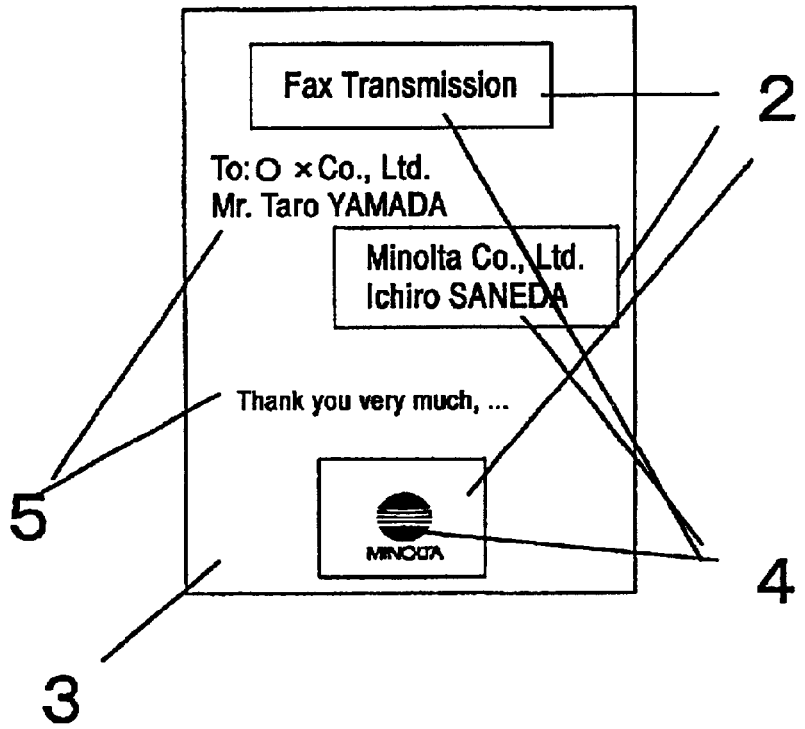
FIG. 12 is a drawing that shows still another embodiment of an image-recording medium in accordance with the second invention.
Figure 12:
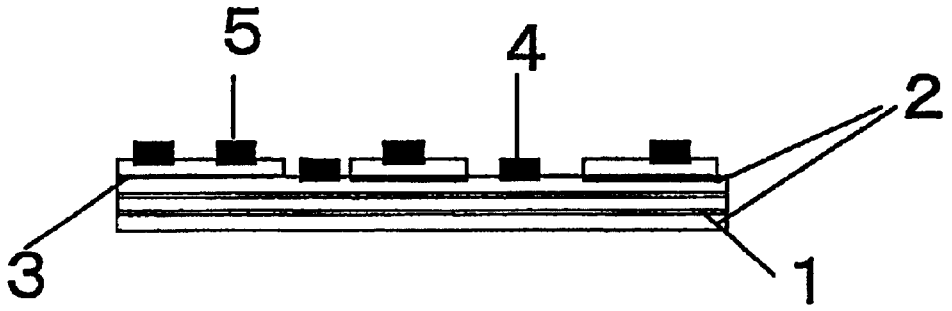

A resin solution for forming a surface layer was obtained in the same manner as example B1. After having masked the pre-print image formed in the above-mentioned process with a masking tape, the resin solution was applied to the entire surface of the sheet and dried to form a surface layer 3. The coating and drying conditions were the same as those of example B1. An image (see reference numeral 5 in FIG. 12) was printed only on the surface layer 3 to form sheet B4. FIG. 12 is a schematic diagram showing sheet B4.

The sheet B4 was subjected to a removing process for the printed material by using a cleaning device shown in FIG. 8. The printed material 4 forming the pre-print image was not removed with only the printed material 5 on the surface layer 3 being removed.

What is claimed is:

1. A recyclable image-recording medium comprising:

a base layer;

a surface layer comprising a water-swelling resin, the surface layer allowing printed materials formed thereon to be separated upon application of an aqueous solvent, in which the surface of the image-recording medium has a portion that is not covered with the surface layer, wherein the water swelling resin comprises a water-soluble resin which has been cross-linked to the extent that the layer swells when contacted with an aqueous solvent, thereby loosening the bond between an image present on the surface layer and said layer and allowing the image to be removed.

2. The image-recording medium of claim 1, wherein the base layer is exposed at the portion that is not covered with the surface layer.

3. The image-recording medium of claim 1, wherein an image is present on the surface layer and is removable when the surface layer is swelled by contact with an aqueous solvent, and wherein an image not so removable is present on the surface of the base layer that is not covered with the surface layer.

4. The image-recording medium of claim 1, wherein the surface layer contains a surface active agent.

5. The image-recording medium of claim 1, wherein the surface layer contains inorganic fine particles.

6. The image-recording medium of claim 1, wherein the surface layer contains a surface active agent and inorganic fine particles.

7. The image-recording medium of claim 1, wherein the base layer is a plastic film.

8. The image-recording medium of claim 1, wherein a cross-linking agent is added to the surface layer in an amount of 0.5 to 50 parts by weight per 100 parts by weight of the resin.

9. The image-recording medium of claim 4, wherein the surface active agent is added in an amount ranging from not less than 0.1% to not more than 20% with respect to the resin.

10. The image-recording medium of claim 5, wherein the inorganic fine particles are added in an amount ranging from 0.5 to 200 parts by weight based on 100 parts by weight of the water-soluble resin.

11. The image-recording medium of claim 1, wherein the surface layer contains a surface active agent and inorganic fine particles, the surface active agent being present in an amount ranging from not less than 0.1 to not more than 20% with respect to the resin, and the inorganic fine particles being present in an amount ranging from 0.5 to 200 parts by weight per 100 parts by weight of the resin.

* * * * *